US012344419B2

(12) United States Patent
Monti

(10) Patent No.: US 12,344,419 B2
(45) Date of Patent: Jul. 1, 2025

(54) TAPING UNIT FOR GUMMED PAPER TAPE AND BOX CLOSING MACHINE INCLUDING SAID TAPING UNIT

(71) Applicant: S.I.A.T. SOCIETA' INTERNAZIONALE APPLICAZIONI TECNICHE S.p.A., Milano MI (IT)

(72) Inventor: Andrea Monti, Milano MI (IT)

(73) Assignee: S.I.A.T. SOCIETA' INTERNAZIONALE APPLICAZIONI TECNICHE S.P.A., Milan (IT)

( * ) Notice: Subject to any disclaimer, the term of this patent is extended or adjusted under 35 U.S.C. 154(b) by 287 days.

(21) Appl. No.: 18/080,204

(22) Filed: Dec. 13, 2022

(65) Prior Publication Data

US 2023/0182945 A1 Jun. 15, 2023

(30) Foreign Application Priority Data

Dec. 14, 2021 (IT) ..... 102021000031241

(51) Int. Cl.
*B65B 51/06* (2006.01)
*B65B 61/06* (2006.01)
*B65H 35/00* (2006.01)

(52) U.S. Cl.
CPC ..... *B65B 51/067* (2013.01); *B65B 61/06* (2013.01); *B65H 35/0053* (2013.01);
(Continued)

(58) Field of Classification Search
CPC ... B65B 51/067; B65B 61/06; B65H 35/0013; B65H 35/0046; B65H 35/0053;
(Continued)

(56) References Cited

U.S. PATENT DOCUMENTS 2,052,903 A * 9/1936 Stagmeler ..... B65B 51/067 156/DIG. 4
5,478,430 A * 12/1995 Marchetti ..... B65B 51/067 156/578

(Continued)

FOREIGN PATENT DOCUMENTS

EP 1 299 284 4/2003
EP 3 854 737 7/2021

OTHER PUBLICATIONS

Search Report and Written Opinion for IT202100031241, dated Jul. 19, 2022, 8 pages.

*Primary Examiner* — Michael A Tolin
(74) *Attorney, Agent, or Firm* — NIXON & VANDERHYE

(57) ABSTRACT

A taping unit for a box closing machine is disclosed, including: an enclosure frame; a gummed tape reel and a plurality of running rollers mounted on the frame; at least an applicator roller arranged in the bottom part of the enclosure frame; and a guiding and sliding path of the gummed tape within the enclosure frame. The taping unit further includes: an operating assembly provided with a respective frame movably mounted on the enclosure frame, whereon a drive motor of a drive roller and at least an actuator to operate a cutting blade are installed; and a wetting system provided with a tank storing wetting liquid arranged in a position below the operating assembly. Between the drive roller and the wetting system, the guiding and sliding path is provided, arranged according to a substantially vertical plane.

6 Claims, 6 Drawing Sheets

(52) U.S. Cl.
CPC . *B65H 35/0086* (2013.01); *B65H 2301/5142* (2013.01); *B65H 2301/51532* (2013.01); *B65H 2801/81* (2013.01)

(58) Field of Classification Search
CPC ..... B65H 35/006; B65H 35/0066; B65H 35/008; B65H 35/0086; B65H 35/0093; B65H 35/04; B65H 35/06; B65H 43/00; B65H 2301/5142; B65H 2301/5151; B65H 2301/51532; B65H 2404/143; B65H 2404/611; B65H 2801/81
See application file for complete search history.

(56) References Cited

U.S. PATENT DOCUMENTS 5,759,338 A * 6/1998 Marchetti ..... B65B 51/067 156/468
5,904,805 A * 5/1999 Marchetti ..... B65B 51/067 156/577

* cited by examiner

TAPING UNIT FOR GUMMED PAPER TAPE AND BOX CLOSING MACHINE INCLUDING SAID TAPING UNIT

This application claims priority to IT Patent Application No. 102021000031241 filed Dec. 14, 2021, the entire contents of which is hereby incorporated by reference.

FIELD OF THE INVENTION

The present invention relates to a taping unit or head for automatic or semi-automatic box closing machines, in particular a taping unit for gummed paper tape.

BACKGROUND ART

As is known, machines for packing are used in the packaging sector that close containment boxes, usually made of corrugated cardboard, and seal them with self-adhesive tape or with gummed tape. The boxes typically have pairs of opposing flaps that are folded together until they come into contact and joined by adhesive tape.

Typically, at a preliminary packaging step, the flaps on a bottom side of a box are closed together (and possibly taped) to form the bottom of the packaging container. The box is then filled with the desired objects (e.g. a plurality of small articles in bulk) and finally routed to a taping machine. The latter is provided with a conveying mechanism, for example motorized feed belts, which engage the box and guide it along a path along which it encounters one or two opposing tape applicators (typically an upper and a lower one) which take care of applying accurately the adhesive tape so as to fix and seal the flaps (either only the top side or the bottom and top opposing sides), normally along the axis of symmetry of the box.

A semi-automatic taping machine of the prior art is for example the model "XL35" produced by the same Applicant and represented in FIG. 1. Typically, on a support frame Fr there is provided a transport roller conveyor Fr1, which defines a sliding plane of the boxes (not shown), adjacent to which there are arranged two parallel conveyor belt units Na and Nb, with feed belts N arranged on a closed circuit around vertical axes and brought into motion by respective motors Ma and Mb: when the box to be closed comes into engagement with the belts N, it is dragged along the longitudinal axis of the machine resting on the roller conveyor Fr1.

The configuration of the conveying system may also be different.

A taping applicator head is provided above the sliding plane, at a height that varies according to the height of the boxes.

The taping head depicted in FIG. 1 is designed to dispense and apply a classic adhesive tape with plastic film substrate. This technology—also called PST (pressure sensitive tape)—is widely established and does not entail particular tape processing problems.

As an alternative to PST tape, a gummed tape—also called WAT (water activated tape)—can be used, normally consisting of a paper substrate on which a deactivated (dry) glue is applied. This type of tape must be activated by wetting, before being applied to seal the box. The WAT-type tape has the advantage of being normally paper-based, therefore environmentally friendly, and that its adhesion with the cardboard box is greater, which reduces risks of accidental opening or tampering (with fraudulent opening) of the packaging.

Evidently, the application of gummed tape requires a special taping head, where an adequate wetting of the side provided with dry glue can be achieved. In most cases the WAT tape is applied manually by means of manual dispensers, for example those described in US20120090791 or U.S. Pat. No. 3,413,954. There are also taping units for box closing machines that allow the use of the WAT tape, but their diffusion is limited due to the complexity of use and the problems of cleaning and maintenance. Furthermore, these units are integrated in the box closing assembly, at the top of the machine, which makes their maintenance even more complicated.

A taping machine with gummed paper tape, with wetting on a vertical plane, is described for example in EP-465771.

It follows that these machines have found little appreciation in the market.

SUMMARY OF THE INVENTION

It is therefore an object of the present invention to provide an improved taping unit, which satisfies a series of requirements to make it more acceptable in the industrial market.

In particular, it is intended to provide a taping unit or head that is mechanically autonomous and independent of the box closing machine, so as to be applicable on any new or existing machine, which is compact and easily removable in order to facilitate maintenance or replacement, which is designed to require reduced maintenance and simplify cleaning operations and finally, optionally, which does not require frequent supplies of the wetting liquid (typically water).

A solution according to the invention is achieved by means of a taping machine having the features defined in the independent claim appended hereto. Other preferred features of the invention are defined in the dependent claims.

BRIEF DESCRIPTION OF THE DRAWINGS

Further features and advantages of the invention will anyhow be more evident from the following detailed description of preferred embodiments of the same, provided by mere way of non-limiting example and illustrated in the accompanying drawings, wherein.

DETAILED DESCRIPTION OF A PREFERRED EMBODIMENT

Figure 1:
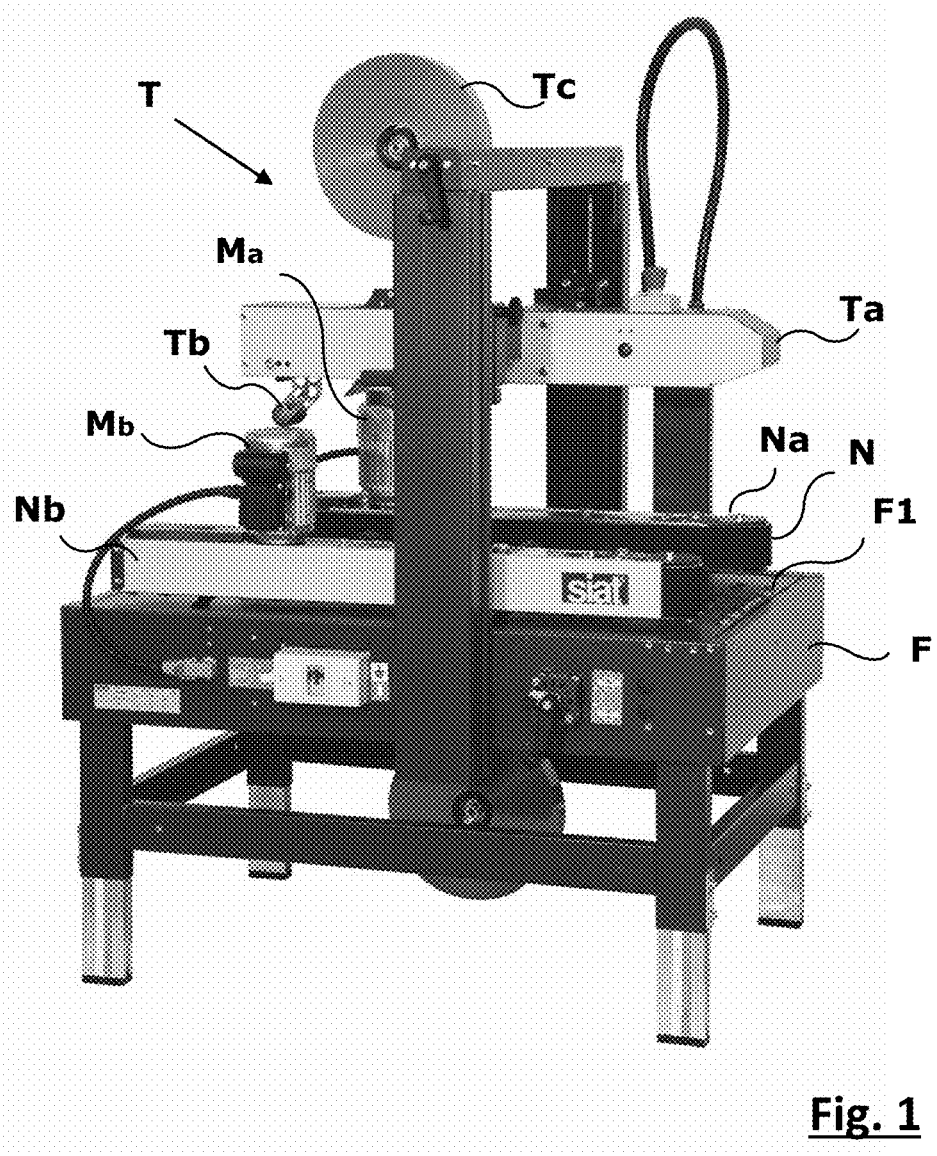
FIG. 1, as anticipated, is a perspective view of an exemplary box closing machine of the prior art.
Figure 2A:
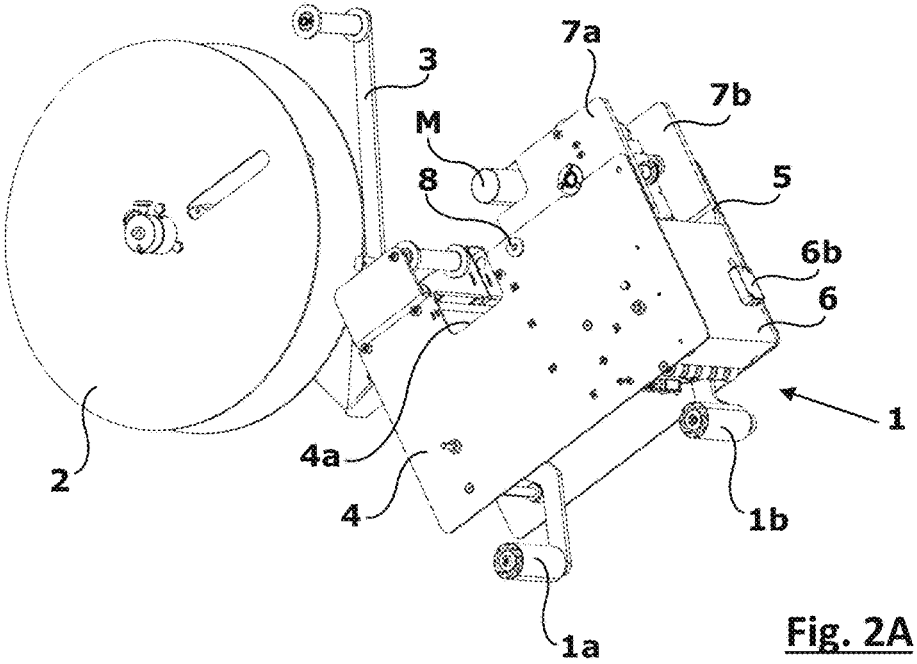
FIGS. 2A and 2B are views according to two different perspectives of a taping unit according to the invention.
Figure 2B:
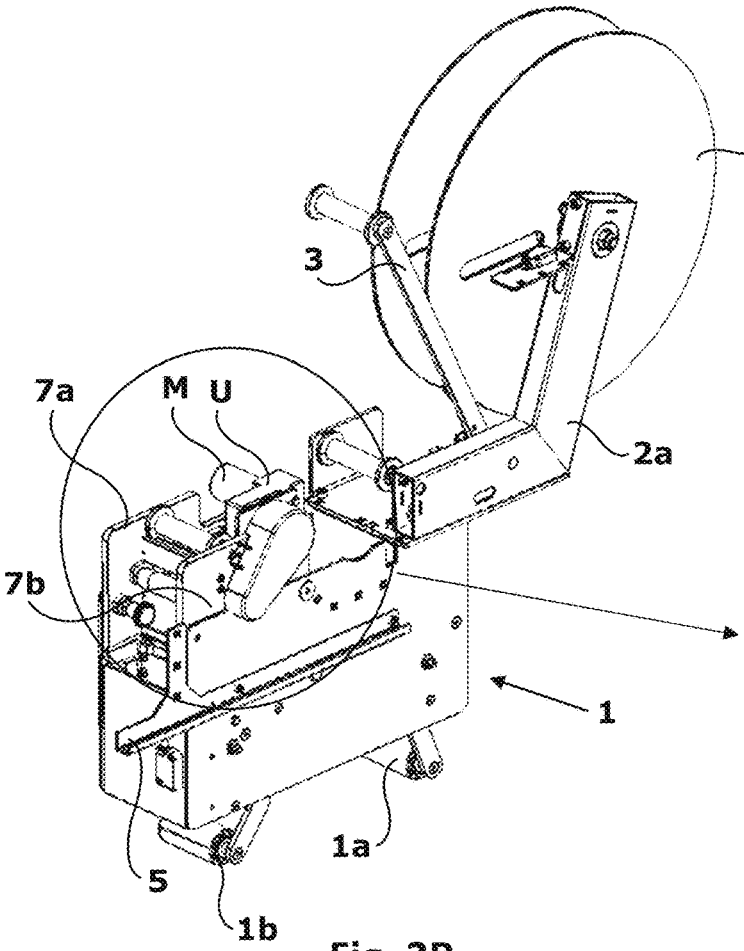
Figure 2C:
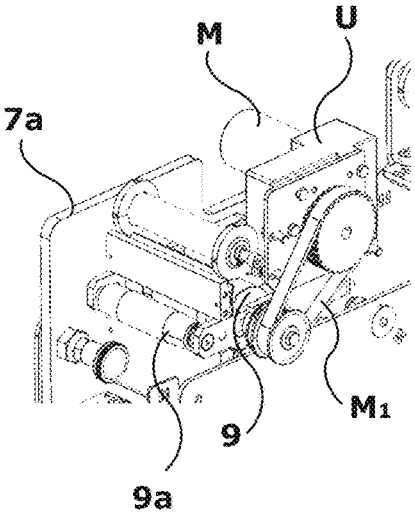
FIG. 2C is an enlarged view of the detail enclosed in the circle of FIG. 2B with removed parts.

A taping unit according to the invention is illustrated in FIGS. 2A and 2B. This unit is intended to be mounted on a top head of a box closing machine.

As well represented, the unit consists of a chassis or enclosure frame 1, which supports a rotating reel 2 and a tensioning arm 3 designed to maintain the correct tensioning of a gummed tape that is unwound by the reel 2. The tensioning arm 3 (also called dancing roller) is mounted oscillating through elastic means, so as to maintain the correct tensioning of the tape that runs on it during delivery, to absorb the variations in tension in the transients.

The reel 2 is in fact intended to accommodate a certain amount of box closing tape, in particular a gummed tape with paper-based substrate. The gummed tape has an adhesion surface, coated with a dry glue, which must be activated with a wetting liquid just before its application.

From the bottom part of the enclosure frame 1 two applicator rollers 1*a* and 1*b* extend, which are known per se and used in traditional taping heads.

The enclosure frame 1 is preferably formed by a pair of side plates 4 and 5, kept parallel and spaced by suitable internal spacers.

The plates 4 and 5 have a substantially rectangular shape, preferably with an upper edge provided with a cutout 4*a* which has the function that will be illustrated below. The reel 2 is pivotally mounted to an upper end of a support arm 2*a* attached to a bracket 2*b* mounted in an upper rear part of the enclosure frame 1.

Between the walls 4 and 5 of the enclosure frame 1, in a front part thereof, it is provided a drawer tank 6 and an operating assembly 7 intended to drive the gummed tape.

Figure 3A:
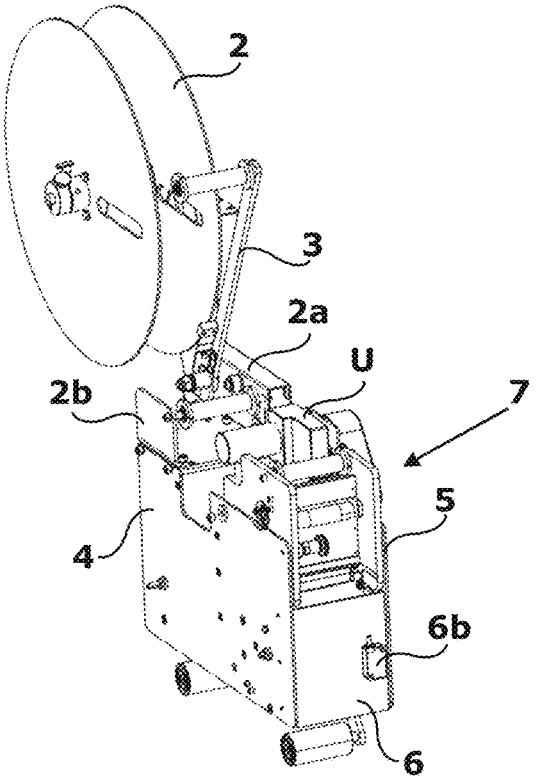
FIGS. 3A and 3B are perspective views of the unit of FIG. 2A respectively in an operating condition and a maintenance condition.

The drawer tank 6 is mounted on the front side of the frame 1 in a lower position and is intended to contain the wetting liquid for the gummed tape, typically water. According to a preferred embodiment, the drawer tank 6 is coupled to vertical guides 6*a*, provided on the inner sides of the plates 4 and 5, in order to be removed from the frame 1 by vertical sliding (arrow E), passing from the operating position illustrated in FIG. 3A to an extracted position shown in FIG. 3B.

The drawer tank 6 is provided with a supplying aperture on a side thereof—i.e. an aperture facing its back side where a gummed tape is intended to slide—which is arranged so as to let the wetting liquid be dispensed toward the gummed tape, for example through a porous material on which the tape is made to slide. By converse, the wetting liquid can be loaded into the tank from an upper aperture.

The wetting system—including the tank 6 and the wetting means to deliver wetting liquid to the tape—will not be described further in this context, since it is not a specific object of the inventive solution provided herein.

On the front side of the drawer tank 6 there is preferably provided a level sensor 6*b* and a filling valve (not shown) to which a water supply pipe (not shown) is connected. The filling valve opens each time a water level lower than a preset threshold is detected with the sensor 6*b*, so as to restore the water level within the tank 6 as it is consumed.

The operating assembly 7 is arranged in the upper front part of the frame 1, above the drawer tank 6.

According to a peculiar feature of the invention, the operating assembly 7 is mounted tilting about a transverse axis 8, so as to be able to rotate from an operating position (FIGS. 2A and 3A)—in which it is engaged above the underlying drawer tank 6, preventing it from sliding along the guides 6*a*—to a maintenance position (FIG. 3B) in which it is rotated towards the rear part of the unit, exposing some operating elements to facilitate access and maintenance.

In the exemplary illustrated embodiment, the operating assembly 7 has a frame consisting of two opposing plates 7*a* and 7*b* between which a series of gummed tape running rollers, a control motor M, a drive roller 9 and at least a first and a second actuator 10 and 11 are provided.

The control motor M is arranged at the top of the operating assembly 7 and controls the rotation of the drive roller 9, for example, in the illustrated embodiment, by means of a toothed belt M1.

Figure 4A:
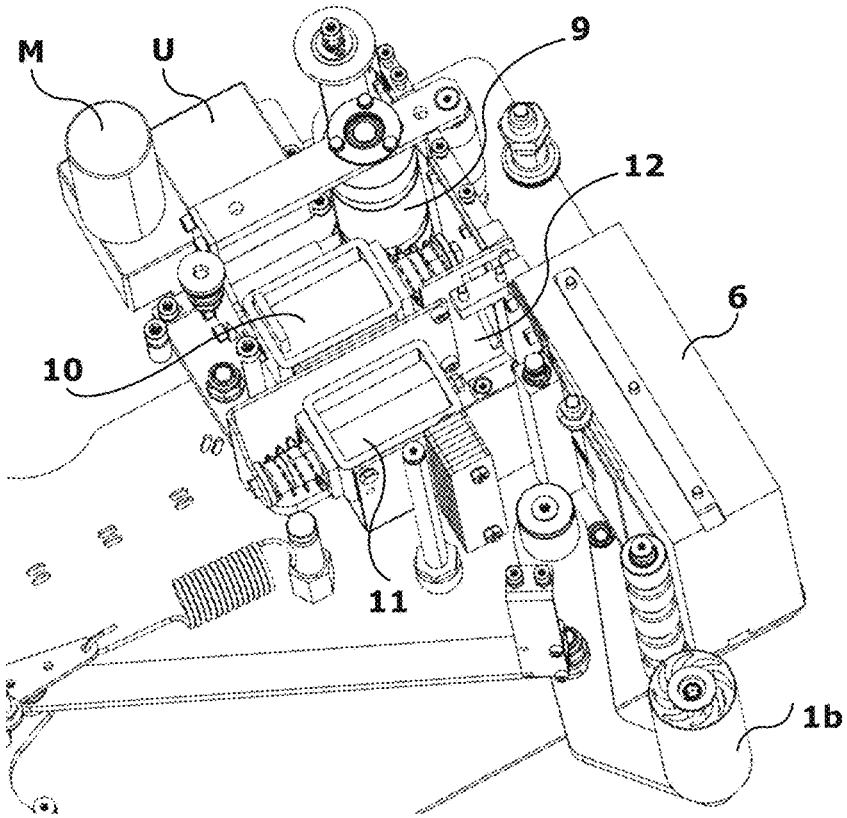
FIGS. 4A, 4B and 4C are three different perspectives views of a detail of the operating assembly with removed parts.
Figure 4B:
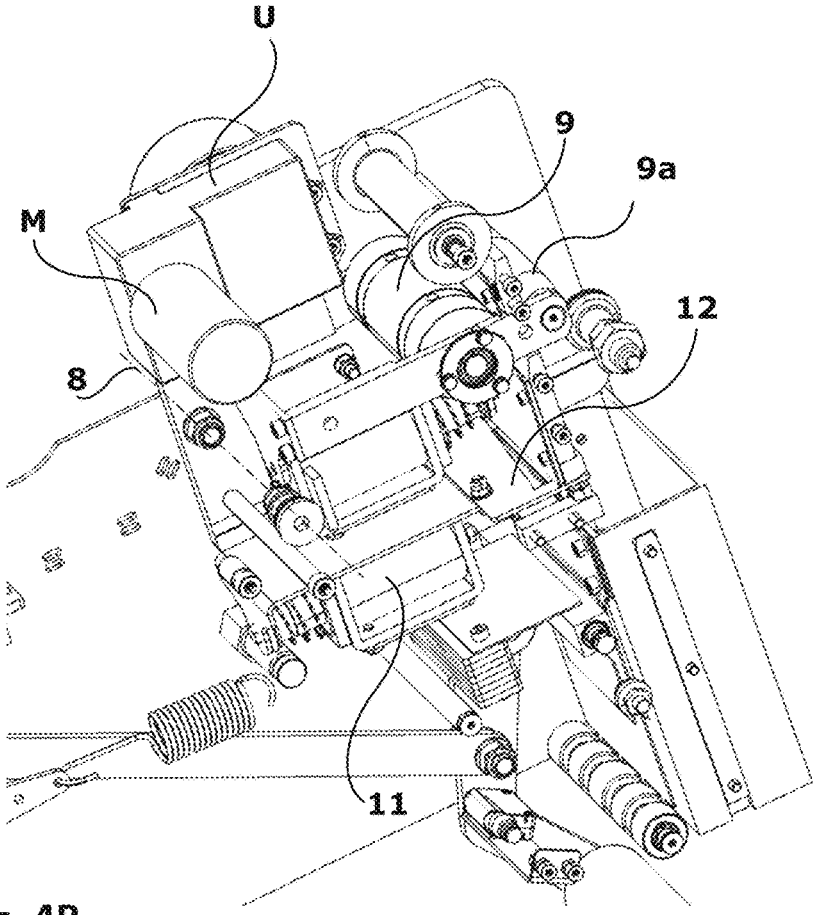
Figure 4C:
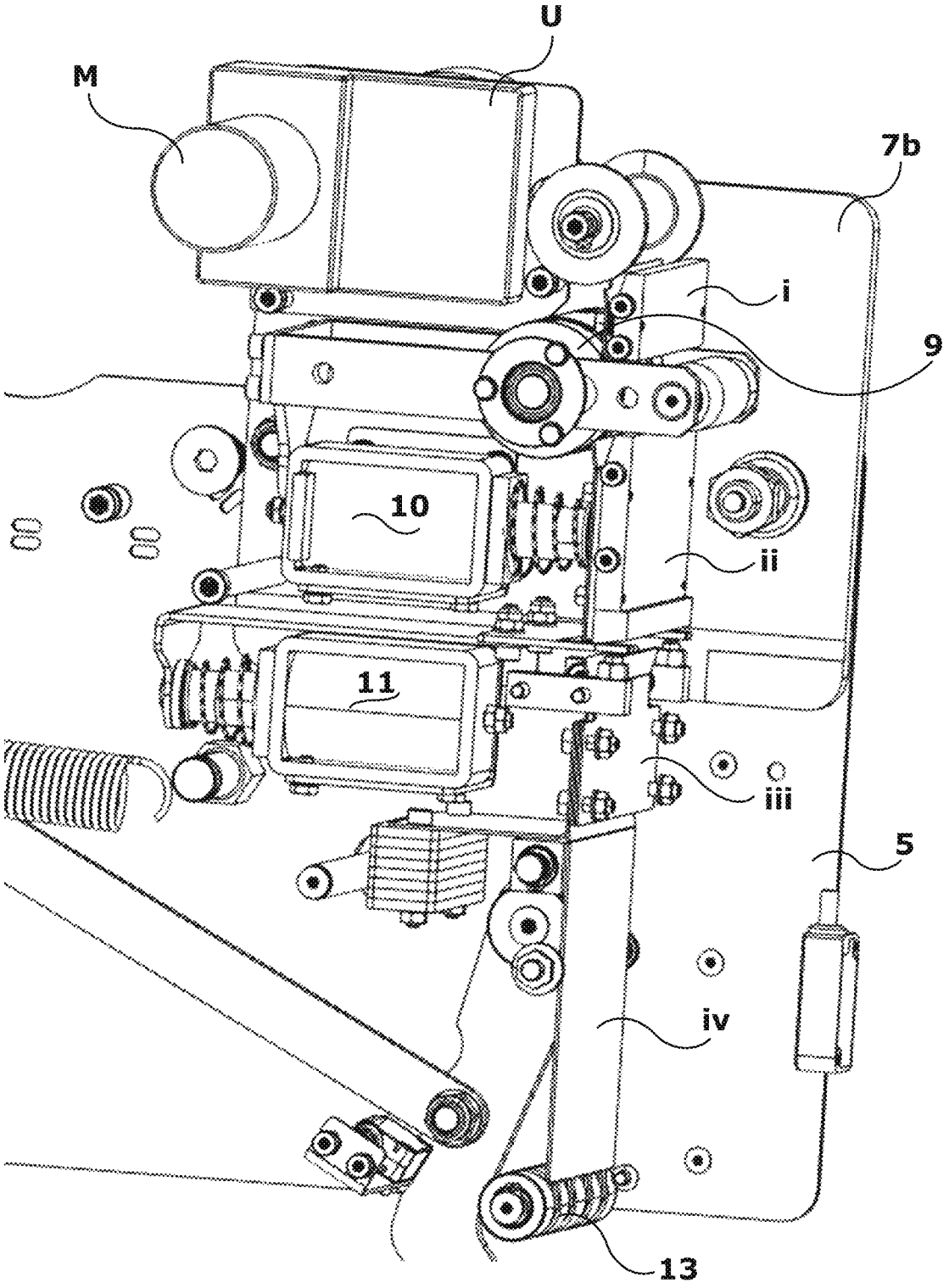

The drive roller 9 has the function of controlling the movement of the gummed tape, which extends between the reel 2 and a guiding and sliding path, arranged according to a substantially vertical plane, defined by plates marked with the references i, ii, iii, iv in FIG. 4C, between the drive roller 9 and the underlying wetting system (not shown in detail). As can be understood from the figures, part (i, ii, iii) of the guiding and sliding path is mounted integrally to the frame, i.e. to the plates 7*a* and 7*b*, of the operating assembly 7, while part (iv) is fixed to the plates 4 and 5 of the enclosure frame 1.

The guide plates i, ii, iii, iv are configured to define a path along a channel of maximum width of about 1.5 mm, so that the tape can also be delivered with a pushing action by the drive roller 9 without suffering significant bends, which would result in possible jams.

The end flap of the gummed tape (not illustrated) must be delivered towards the wetting system and then applied on a box (by means of the roller 1*b*), only when needed, then delivering it in a controlled manner by means of the motor M.

To this end, the drive roller 9 acts on the gummed tape in contrast with a pressure roller 9*a*, which is approached (when the tape needs to be actively delivered) or moved away from the drive roller 9 by means of the first actuator 10. The actuator 10 brings the pressure roller 9*a* closer to the motorised drive roller 9 when active pushing of tape is required, whereas it disengages the pressure roller 9*a* when the tape is dragged by the box and as little resistance as possible is needed to be created.

A cutting blade 12 controlled by the second actuator 11 is provided between the drive roller 9 and the wetting system.

The two actuators 10 and 11 are preferably in the form of electromagnetic actuators (as illustrated in FIGS. 4A and 4B), then controlled by means of electrical controls from the same control unit of the motor M. Alternatively, pneumatic actuators may be provided.

With this construction, the gummed tape passes on running rollers, then it is taken over in the gap between the drive roller 9 and the pressure roller 9*a*, then in the gap defined by the plates i and ii, ending in coincidence with the cutting blade 12.

Preferably, there is also provided a system for measuring the amount of tape delivered, such as a rolling length counter: this makes it possible to track the consumption of tape, but also to detect any operating anomalies such as the breakage of the tape or the failure to adhere to the box.

A control unit U of these operating parts is preferably installed on board the same taping unit—for example a circuit board incorporated in a casing integral with that of the motor M—so as to make the operation of the unit autonomous and independent of the choices of control over the box closing machine.

Finally, the taping unit according to the invention has universal coupling means, for example a bayonet coupling slide S, which allows its installation and removal without tools from the top frame of the box closing machine.

In operation it is provided that, when the box closing machine detects a box to be closed approaching—with techniques known per se—the motor M is controlled so as to set in rotation the drive roller 9 and push downwards the gummed tape, until causing the end flap to come out of the unit at an end roller 13 and then close to the applicator roller 1*b*. In this sliding, the gummed tape passes through the wetting system, being activated accordingly.

At this point the motor M is stopped and through the actuator 10 the corresponding pressure roller 9*a* is disengaged.

When the box comes into contact with the tape flap and the applicator roller 1*b*, the tape itself adheres to the box that start dragging it.

When the box tail (i.e. the back side of the box) is detected, the control logic determines the necessary tape length and controls the cutting of the tape through the blade 12.

The end flap of the tape continues its sliding along the guiding and sliding path, simply drawn from below by the action of the applicator roller 1*b*, so that the entire portion of wetted tape completely leaves the taping unit.

When a new box to be closed arrives, the dispensing cycle is repeated.

As the wetting liquid is consumed, its level inside the drawer tank 6 decreases: according to a preferred embodiment, when the level sensor 6*b* determines that a lower threshold is reached, the filling valve is opened, which returns the liquid to the desired level.

The end plate iv of the guiding path, in front of the wetting system, is preferably heated, by means of a electric resistance and a temperature control that are managed by the logic unit, to ensure an optimal temperature for glue activation, typically between 40 and 60° C.

Figure 3B:
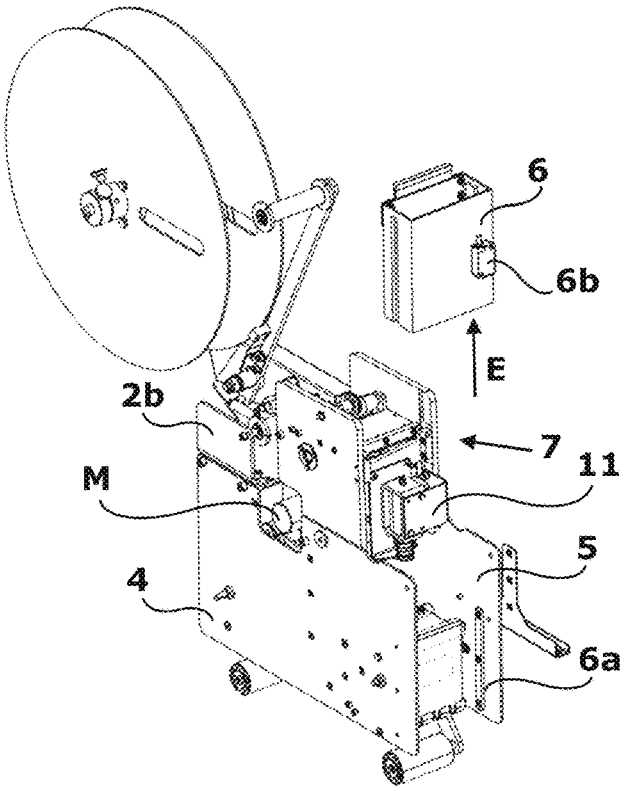
Figure 5A:
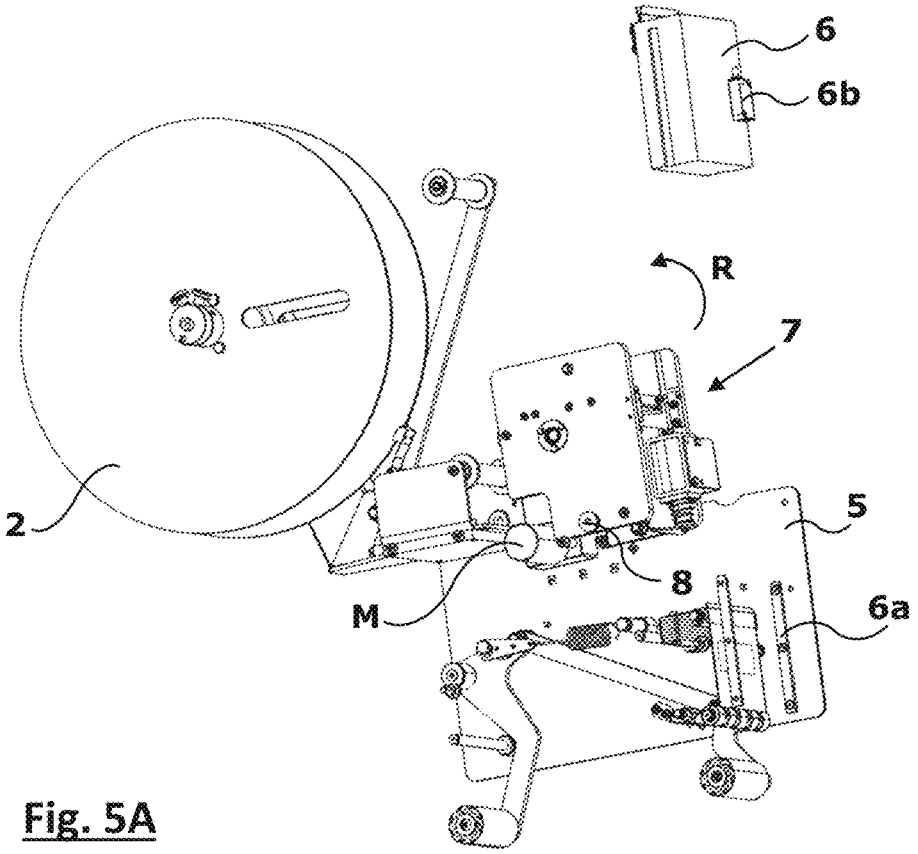
FIG. 5A is a perspective view, with removed parts, of the unit according to the invention in the maintenance condition of FIG. 3B.
Figure 5B:
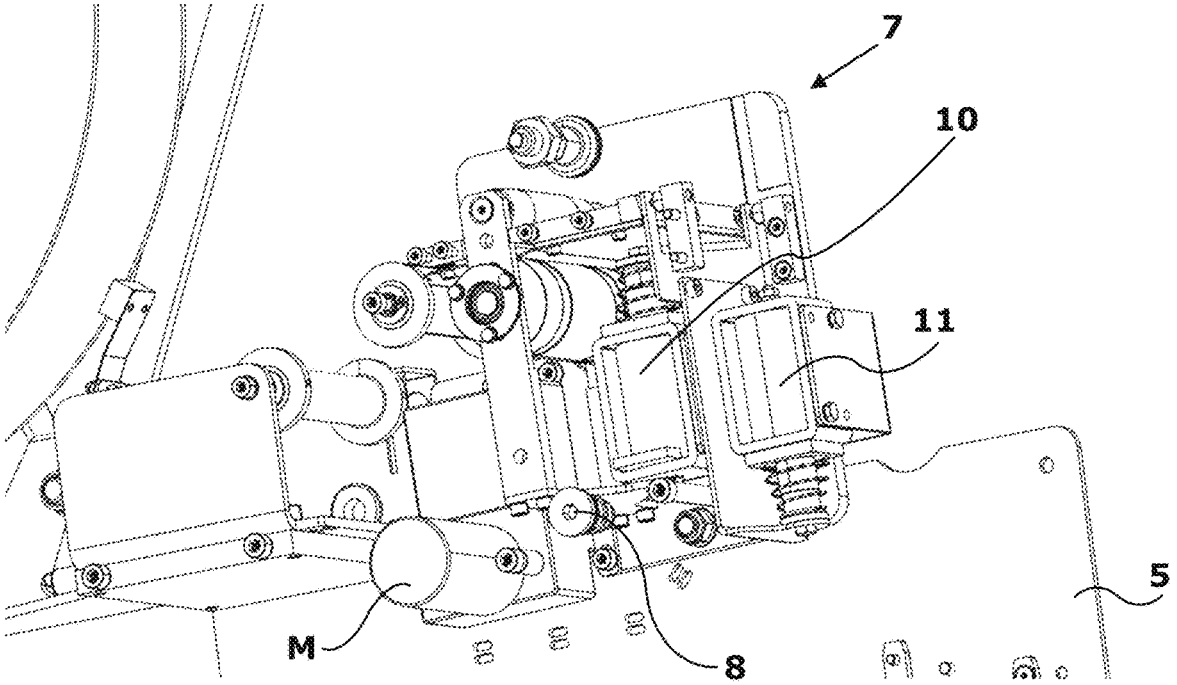
FIG. 5B is an enlarged view of a detail of FIG. 5A with further parts removed.

When it is necessary to carry out a maintenance of the operating parts of the taping unit, it is possible to tilt the operating assembly 7 backwards around the rotation axis 8 (arrow R), in the state shown in FIGS. 3B, 5A and 5B. The cutout 4*a* on the plate 4 allows the motor M—even if it has an overall transverse dimension greater than the width of the enclosure frame 1—to rotate by 90° (descending below the rotation axis 8). In this condition, the drawer tank 6 is free to slide upwards and it can be completely removed from the frame 1 (as represented in FIGS. 3B and 5A), possibly after removing the water connections to the filling valve. The majority of the assembly 7 thus is accommodated above the walls 4 and 5 and is exposed in the upper part of the enclosure frame 1.

The operator can thus comfortably access the actuators 10 and 11 and the components forming the guiding and sliding path, to perform an accurate maintenance. The tank 6 can be comfortably cleaned or replaced.

As can be well understood, the taping unit thus configured fully satisfies the purposes stated in the introduction.

In particular, it is completely autonomous, because it is sufficient to connect the control unit U to an electrical power source (for example at 24V) and a communication line with the detection sensors (for example position and format of the boxes) of the box closing machine, in order to achieve the full and autonomous operation of the unit.

It should also be noted that the operating devices, which perform the main functions (drawing, cutting, wetting of tape) are placed along a vertical plane in order to facilitate the running-in of the gummed tape and avoid bends that can cause blockages and jams.

Moreover, the compactness and integration of the operating parts in the operating assembly 7, allows easy access for maintenance purposes, through a simple tilting of the entire assembly, without having to disassemble anything. The drawer tank 6, which contains the wetting liquid, can be easily removed and then cleaned or replaced.

Mounting the unit on board a box closing machine is very simple, using bayonet elements.

It is however understood that the invention is not limited to the particular configuration illustrated, which represents a non-limiting example of its scope, but that numerous variants are possible, all within the reach of a skilled in the art, without thereby departing from the scope of the invention.

For example, although in the figures an operating assembly 7 being mounted tilting around an horizontal pivot has always been illustrated, to switch from an operating position to an pivoted position allowing easy disengagement of the drawer tank 6, this is not the only possible mounting mode. The assembly 7 could also be slidingly mounted movably, back and forth, to perform a similar function.

The invention claimed is:

1. A taping unit for a box closing machine, the taping unit comprising:

an enclosure frame;

a gummed tape reel configured to hold gummed tape;

a plurality of running rollers mounted on said enclosure frame;

at least one applicator roller disposed in a bottom part of said enclosure frame;

a plurality of plates defining a guiding and sliding path of said gummed tape within said enclosure frame;

an operating assembly comprising a respective frame movably mounted on said enclosure frame, a drive roller, a drive motor connected to the drive roller, a cutting blade, and at least one actuator configured to operate the cutting blade; and a wetting system comprising a tank storing wetting liquid, the tank being disposed in a position below said operating assembly, wherein said guiding and sliding path extends between the drive roller and the wetting system, and wherein the plurality of plates and the guiding and sliding path are arranged in a substantially vertical plane, and wherein said operating assembly is movably mounted between an operating position, in which the operating assembly prevents said tank from being removed, and a disengagement position in which said tank is released.

2. The taping unit as in claim 1, wherein said tank is removably mounted.

3. The taping unit as in claim 1, wherein said operating assembly is pivotally mounted about a rotation axis, the operating assembly being integral with said enclosure frame.

4. The taping unit as in claim 3, wherein said tank is slidably mounted to be movable on a front side of said enclosure frame, a sliding movement being hindered by said operating assembly and being released when said operating assembly is back rotated about said rotation axis.

5. The taping unit as in claim 1, wherein said operating assembly further comprises a controller.

6. A box closing machine comprising:

a support frame;

a transport roller conveyor mounted to the support frame and defining a sliding plane; and a top tape applicator head installed above the sliding plane, said top tape applicator head comprising the taping unit according to claim 1.

* * * * *